United States Patent [19]

Kovaleski

[11] 4,269,371

[45] May 26, 1981

[54] COMPOSITE, HEAVY-DUTY SPOOL WITH PLASTIC END CONES

[75] Inventor: Joseph J. Kovaleski, Easton, Conn.

[73] Assignee: Wyrepak Industries, Inc., Bridgeport, Conn.

[21] Appl. No.: 126,065

[22] Filed: Feb. 29, 1980

[51] Int. Cl.[3] ..... B65H 75/14

[52] U.S. Cl. ..... 242/118.6; 242/77; 242/116; 242/118.7

[58] Field of Search ..... 242/118.6, 118.61, 118.62, 242/118.7, 118.8, 118.4, 118.3, 118.31, 118.32, 77, 77.3, 77.4, 115, 116

[56] References Cited

U.S. PATENT DOCUMENTS

| | | | |
|---|---|---|---|
| 1,479,106 | 1/1924 | Moss | 242/77.4 X |
| 1,819,337 | 8/1931 | Pevear | 242/77.3 |
| 1,987,990 | 1/1935 | Clinton | 242/118.61 |
| 2,295,222 | 9/1942 | Krentler | 242/118.8 X |
| 2,484,090 | 10/1949 | Hedfield | 242/118.8 X |
| 3,176,932 | 4/1965 | Kovaleski | 242/118.8 |
| 3,414,212 | 12/1968 | Baggen et al. | 242/118.7 |
| 3,940,086 | 2/1976 | Stoquelet | 242/118.6 |
| 3,948,458 | 4/1976 | Beck et al. | 242/118.7 |
| 4,140,289 | 2/1979 | Kovaleski | 242/118.6 |

*Primary Examiner*—Stanley N. Gilreath
*Attorney, Agent, or Firm*—H. Gibner Lehmann; K. Gibner Lehmann

[57] ABSTRACT

A composite, heavy-duty spool with plastic end cones, consisting of a cylindrical spool body of thick, rigid, heavy cardboard having open ends, and a pair of plastic end cones identical to each other. When dismantled, the end cones can nest in each other so as to occupy little space. Each end cone comprises a truncated, conical body portion all parts of which are essentially of uniform thickness. Integral with the conical body portion of each cone is a strengthened peripheral rim of U-shaped cross section defining an annular groove which faces axially away from the body portion. At its small base part, each body portion has a transverse wall that is apertured to receive a draft bolt, and has a plurality of integral strengthening ribs each of which is disposed both on the conical exterior and on the transverse wall exterior. The ribs lie in planes which pass through the axis of the body portion, and are shaped to effect a lead-in formation at the aperture of the transverse wall, to guide a draft bolt to the aperture.

9 Claims, 5 Drawing Figures

Fig. 3
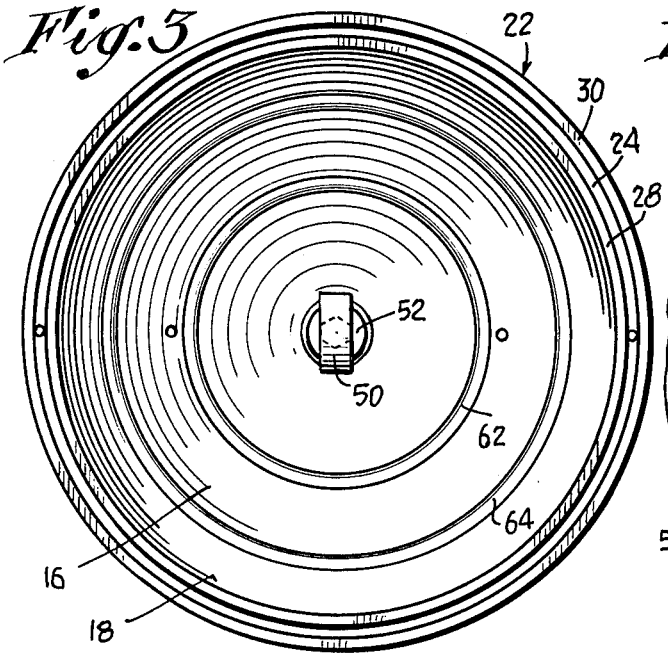
Fig. 4
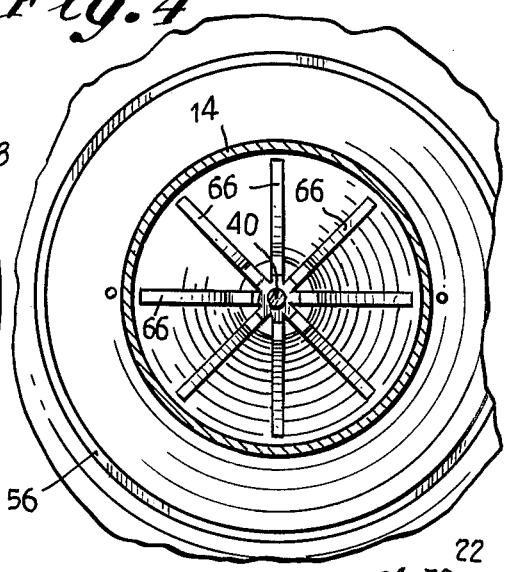
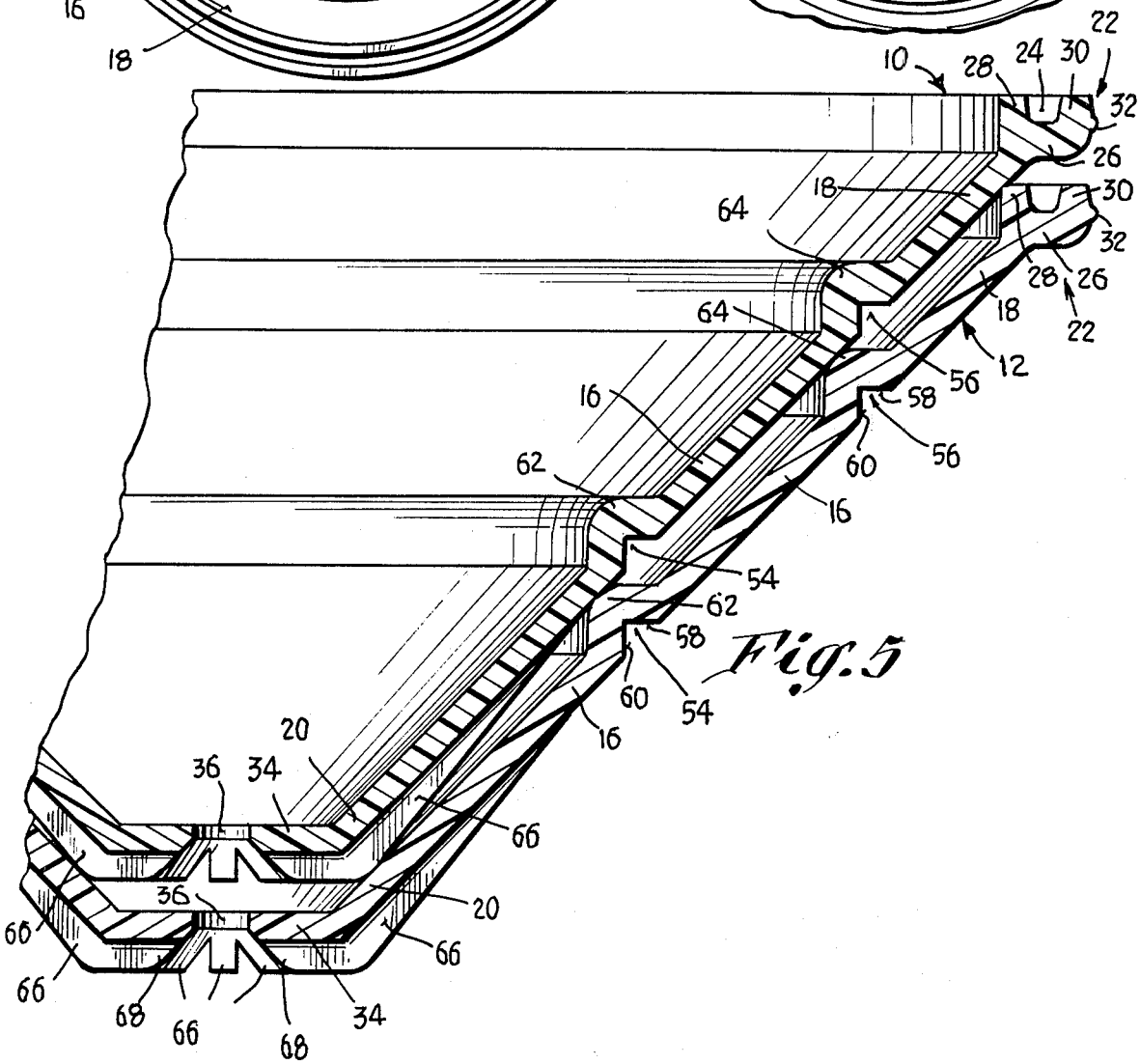
Fig. 5

COMPOSITE, HEAVY-DUTY SPOOL WITH PLASTIC END CONES

BACKGROUND

This invention relates generally to composite, dismantleable spools of heavy-duty construction, adapted to carry substantial quantities and weights of metal wire. More particularly, the invention relates to spools of the above type, which are capable of low-cost fabrication and assemblage while at the same time being particularly sturdy and resistant to damage.

In the past a number of different spool constructions for holding large, heavy quantities of wire have been proposed and produced. Most prior spools consisted of a number of sheet-metal sections which were assembled to one another by welding. Generally, the cost of producing such spools was excessive, due to the relatively heavy gauge metal which was required, in addition to the cost of labor involved with the different welding procedures.

Various spool constructions of the take-apart variety have also been developed over the years. U.S. Pat. No. 2,295,222 discloses one such spool, having a central body portion and single conical end flanges releasably secured thereto. The bore of the body portion is threaded, and a corresponding threaded portion on the end flange is received therein. While this construction was considered satisfactory under certain circumstances, it can be appreciated that the costs involved with providing mating thread formations on multiple sheet-metal parts tended to be rather high, resulting in a product which was prohibitively expensive for many applications or installations.

Another prior spool construction is illustrated in U.S. Pat. No. 1,786,366. The device disclosed therein involves a pair of disk-like end flanges which are fitted to a central spool body that is constituted as an iron pipe. Annular bead formations on one side of each flange are employed for keying the flanges to the body. Multiple bolts are utilized, located off-center with respect to the axis of the spool for securing the flanges together.

While this earlier patented device operated in a generally satisfactory manner, there were still a number of disadvantages inherent in the construction. First, it was found to be quite difficult to assemble the end flanges to the spool body, since there is a tendency for the parts to shift with respect to one another as the bolts are being installed. Second, due to the small radius of curvature of the beads on the end flanges, there is encountered difficulty in effecting a proper seating thereof. Moreover, further problems are experienced in determining the proper torque to be applied to the nuts, in order to achieve a balanced or uniform pressure about the spool periphery. In addition, over-tightening of one or more of the nuts results in deformation of either or both of the end flanges, causing them to weaken and assume a somewhat concave shape. Accordingly, in the above respects the disclosed patented constructions did not prove to be satisfactory from the standpoint of either strength or low manufacturing cost.

Yet another take-apart spool is disclosed in U.S. Pat. No. 1,987,990. Here again, one of the disadvantages found is that multiple parts are involved, having unusual configurations, such as internal stop shoulders and the like, requiring special metal stampings which are costly to produce.

In my U.S. Pat. No. 4,140,289 (Ser. No. 855,279) issued on Feb. 20, 1979 and entitled "LOW-COST, DISPOSABLE, WIRE-STORAGE AND PAY-OUT SPOOL" there is disclosed a spool construction wherein conical end flanges constituted of stamped and pressed sheet metal, are assembled to a cylindrical spool body and held in place by a single drift bolt having at one end an eyelet to enable the spool to be handled by mechanical equipment. This construction of my copending application successfully solves most of the problems encountered in prior spool devices. However, there was required a thorough and costly surface protection of the end cones, failing which these would rust and become unserviceable particularly if subjected to moisture and/or outdoor weather conditions. If preplated or pre-finished metal stock was used prior to the formation of the end cones, the surfaces suffered abrasion and damage, resulting in a product of poor quality. Further, the storage of the end cones had to be in a dry, protected space since outdoor storage was not feasible or practical.

SUMMARY

The above disadvantages and drawbacks of prior spool constructions are obviated by the present invention, which has for an object the provision of a novel and improved, heavy-duty spool for holding and dispensing large and heavy quantities of wire, which is both simple in construction and reliable in operation, and is particularly resistant to the action of moisture and the elements especially as regards the disassembled and nested end cones thereof.

Another object of the invention is to provide an improved, heavy-duty spool as above set forth, wherein the end cones can be readily fabricated of plastic substance whereby no finishing or surface protecting operations are needed, and whereby the likelihood of rusting is completely eliminated.

A further object of the invention is to provide an improved, heavy-duty spool in accordance with the foregoing, which is low in cost and especially economical to manufacture.

Still another object of the invention is to provide an improved, rustproof end-cone construction for heavy-duty spools, which is particularly sturdy and rugged, and resistant to breakage or failure either while it is in use or else during periods of storage.

An additional object of the invention is to provide an improved spool construction as above set forth, which is capable of being readily adapted to accommodate increased quantities of wire merely by substitution of a single part making up the spool.

The above objects are accomplished by the provision of a low-cost, heavy-duty spool construction for holding and dispensing substantial quantities of metal wire, comprising a generally cylindrical spool body having open ends, and a pair of substantially identical conical end cones having annular grooves in their lateral surfaces, in which the end edges of the spool body are received. The small apex portions of the end cones have transverse walls which are apertured,, and a tie bar or bolt extends through the apertures to hold the end cones tightly against the respective ends of the spool body. The arrangement is such that the end cones can be assembled to the body with a minimum of time and effort, and later disassembled, if desired, in order to facilitate shipping and storage of the spool. In use, the conical walls at the apex portions of the end cones are maintained under continual tension, with the spool body being held in constant compression, thereby resulting in an especially rugged construction capable of withstanding rough handling, even over extended periods of use.

Since the end cones can be substantially identical to one another, there results a reduced overall manufacturing cost. In addition, the cylindrical body can be advantageously constituted of cardboard which is quite inexpensive but which has excellent strength and rigidity, sufficient to provide adequate support for the substantial weights being carried. Should either of the end cones become damaged, or alternately if the spool body should become damaged, these can be readily replaced merely by loosening one nut, disassembling the spool, and replacing the desired part. Accordingly, great flexibility is realized. In addition, should it be desired to expand the capacity of the spool, it is only necessary to remove the end cones and substitute a cylindrical body of increased length or diameter, or both. The provision of a single tie bar or bolt disposed at the axis of the spool greatly facilitates such a substitution. This simple replacement of parts is usually not realizable in the spools of the prior art.

Due to the fact that the annular grooves in the end cones provide positive, well-defined seats for the opposite ends of the spool body, there exists no uncertainty as to the proper positioning of these cones during assembly. In addition, such assembly can be greatly simplified by making the bore of the body slightly undersize, to enable the end cones to be momentarily held therein by means of a force fit, as the tie bar is installed. Accordingly, no special tools or fixtures are required.

The end cones are molded of impact-resistant, high strength plastic substance, and are so arranged that all parts thereof are essentially of uniform thickness so as to insure quick and uniform curing of the material. The end cones have conical body portions provided with strengthened peripheral rims encircling the large base parts. The said rims are of U-shaped cross section and define an annular groove which faces axially away from the body portion. The strengthened rims extend both radially outward and radially inward from the large base part of the body portion, and a plurality of integral strengthening ribs is provided, disposed both on the exterior of the conical walls and on the exterior of the transverse walls of the body portions at the small base ends thereof. The strengthening ribs lie in planes which pass through the axis of the body portions, and are shaped to provide a leadin which facilitates the insertion of the draft bolt into the aperture of the end wall.

The conical body portions have annular grooves in their exteriors, disposed concentrically and in spaced-apart relation whereby spool bodies of different diameters can be accommodated to suit particular conditions of use.

Other features and advantages will hereinafter appear.

In the drawings, illustrating a preferred embodiment of the invention:

FIG. 3 is a view taken on line 3—3 of FIG. 1

FIG. 4 is a section taken on line 4—4 of FIG. 1, and

FIG. 5 is a fragmentary axial sectional view of a pair of end cones which have been dismantled and placed in nested relation, for storing in a relatively small space.

Figure 1:
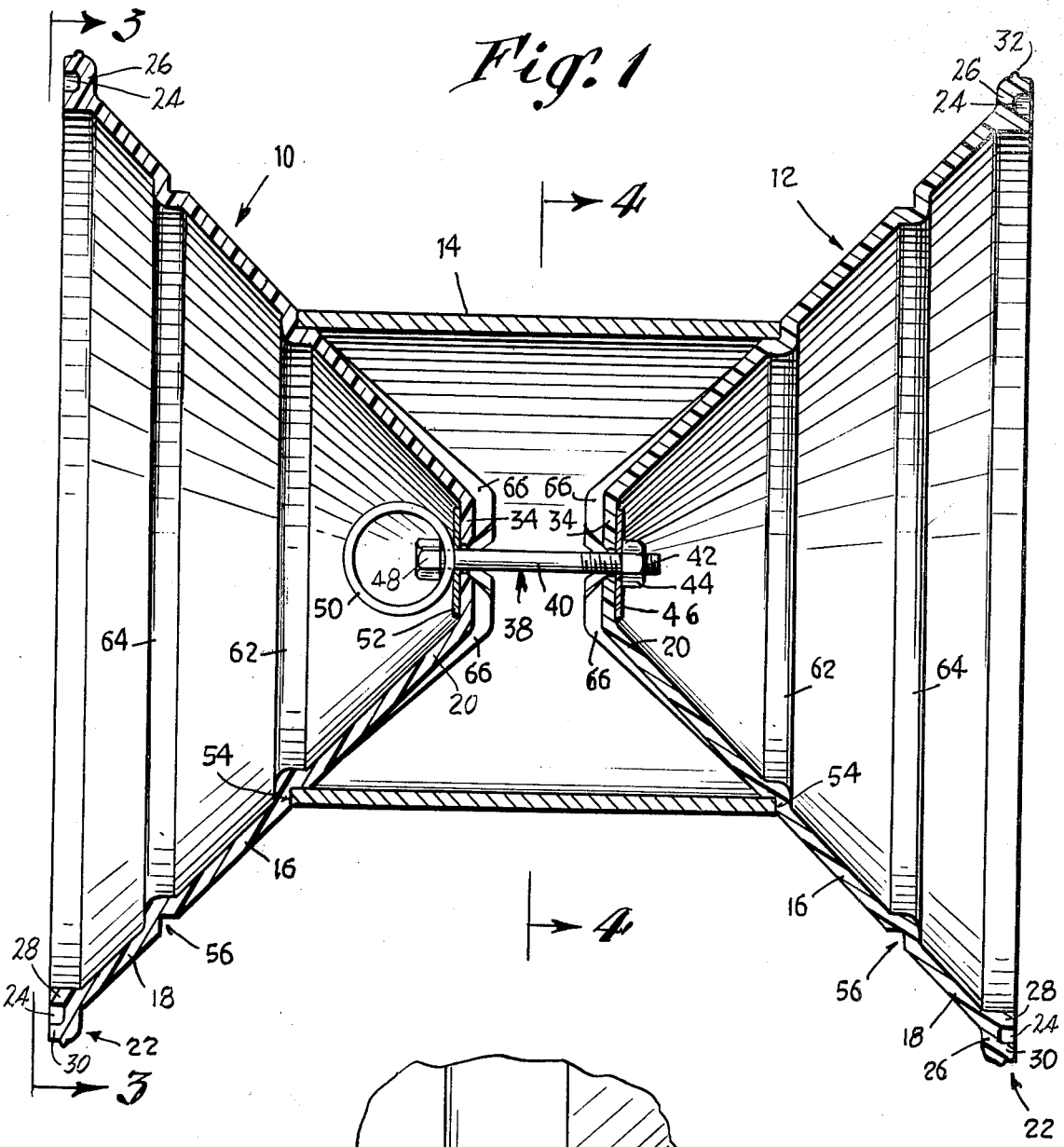
FIG. 1 is a vertical section of the improved spool construction of the present invention, showing a pair of conical end cones secured to a central, substantially cylindrical spool body.

Referring first particularly to FIG. 1, the present improved spool construction comprises a pair of molded, plastic end cones 10, 12 and a cylindrical spool body 14, the latter being advantageously constituted of thick and heavy cardboard whereby its cost is extremely low while at the same time it has excellent resistance to damage or breakage. The spool body 14, for example, can have a thickness of ¼ inch or more whereby it is rigid and resistant to deformation to a considerable degree.

Referring to FIGS. 2–5, the end cones 10–12 are seen to be identical in construction, each cone comprising a truncated, conical body portion 16 all parts of which are essentially of a uniform thickness of plastic to insure quick and uniform curing of the material. Various types of impact-resistant plastic can be utilized, in the molding of the end cones 10, 12. Materials sold under the Tradenames LEXAN and VALOX are suitable, including materials formed of thermoplastic polyester resin, polycarbonate, and A.B.S. plastics. The plastic materials, further, can include glass fibers or other strong fibrous substances to provide additional strength.

The conical body portions 16 have large and small base parts 18, 20 respectively, and have strengthening peripheral rims designated generally by the numerals 22, encircling the large base parts 18. The rims 22 are of U-shaped cross section and define annular grooves 24 which face axially away from the body portions 16.

Each rim 22 is constituted of a web portion 26 which spans the bottom of the groove 24 and is integral with inner and outer flange portions 28, 30. A bead 32 on the outer flange portion 30 can constitute the parting line of the mold in which the end cones are fabricated.

The rims 22, particularly the webs 26 and flanges 30 thereof, are seen to extend radially outward from the large base parts 18 of the body portions 16, and also to extend radially inward of the base parts, particularly the inner flanges 28.

At its small base part 20, each body portion 16 of an end cone has a transverse wall 34 provided with an aperture 36 to receive a draft bolt 38, all as seen in FIG. 1.

The draft bolt 38 comprises a shank portion 40 having at one end threads 42 to accommodate a nut 44 which bears against the end cone 12 through the medium of a large flat washer 46. At its other end the shank 40 of the bolt 38 has a head 48 and passes through a ring 50 which is cut from a steel pipe of suitable diameter and thickness. The ring 50 is drilled to receive the shank 40, with the head 48 abutting the ring inside. A flat washer 52 is disposed between the ring 50 and the transverse end wall 34 of the end cone 10 to distribute the force of the ring against the cone and minimize the likelihood of crushing of the latter.

Figure 2:
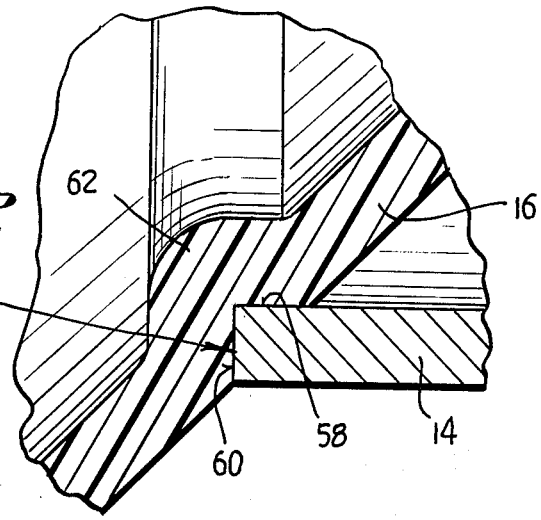
FIG. 2 is an enlarged, fragmentary view of one of the end cones in the vicinity of an annular groove therein, showing a portion of the end of the spool body fitted thereto.

Referring to FIGS. 1, 2 and 5 it is seen that the body portion 16 of each end cone has a plurality of annular grooves 54, 56 in its external, conical surface, said grooves being concentrically located and arranged to receive either small-diameter or larger-diameter spool bodies such as the body 14. While two such grooves are illustrated, it will be understood that three or more of the grooves 54, 56 can be provided. The groove 54 has walls 58, 60 which, when viewed in cross section as in FIG. 2, are perpendicular to each other and adapted to snugly fit the square-cut end of the spool body 14. The groove 56 is similarly formed.

Disposed substantially radially inward of the grooves 54, 56 are annular beads 62, 64 formed in the walls of the cone body portions. The beads 62, 64 are preferably rounded, and essentially provide for a uniform wall thickness of the plastic material of the body portions.

In accordance with the present invention, the end cones 10, 12 are constituted of plastic and in such manner that one may be nested in another and so on, thereby to enable the cones to be stored in a relatively small space when the spools are dismantled. By virtue of the end cones being of special molded plastic substance which is impact-resistant and particularly rugged and durable, they are not subject to rusting, denting, etc. and in any circumstance need not be stored away from a moist atmosphere. Thus, the end cones can be stored outside of a building, if interior space is at a premium.

Further, in accordance with the present invention, the end cones 10, 12 have integral strengthening ribs 66 which are disposed both on the exterior of the conical small base part 20 and on the exterior of the transverse wall 34. As seen in FiG. 3, a total of eight such reinforcing ribs can be provided, resulting in a greatly increased strength at the small base part of each end cone. The strengthening ribs 66 lie in planes which are normal to the axis of the body portion of the end cone. As seen in FIG. 5, the strengthening ribs taper in height to a lesser dimension at their adjoining ends 68, thereby to provide a lead-in formation for guiding the draft bolt 38 to the aperture 36 during the assembly of the spool construction.

Referring to FIG. 5, during the nesting of the end cones, an inner flange 28 of a strengthening rib of one cone and its annular beads 62,64 are adapted for engagement with the outer conical surface on an adjoining body portion of a nesting end cone. Also, the strengthening ribs 66 of the second (nesting) end cone are adapted for engagement with the inner conical surface of the first, adjoining cone. Such engagement occurs along circular lines of contact, and provides increased strength which is important when a large number of end cones are nested in a stack.

It will now be seen from the foregoing that I have provided a novel and improved heavy-duty, dismantleable spool construction which is adapted to carry a substantial quantity and weight of metal wire, said spool construction being readily disassembled and the end cones thereof being capable of nesting and stacking so as to occupy a relatively small storage space. Since the end cones are of molded plastic substance, they need no surface finishing operations and are not susceptible to rusting, denting, etc. With high-impact plastic substance, the end cones are essentially rugged and resistant to breakage, and they may be stored either indoors or outdoors as the occasion requires. The cost of the cones is low, as is also the cost of the spool bodies of built-up cardboard, whereby the entire manufacturing unit-cost is held to a low figure. By using spool bodies of different diameters, the spools can be adapted for smaller or larger quantities of wire, as will be readily understood.

With the above arrangement the spools, when heavy with the weight of wire, can be readily lifted and transported by power equipment which has a lifting cable and hook. The great strength of the assemblage of tubular body 14, cone sections 20 with reinforcing ribs 66, and steel drawbolt 38 with captive eye 50 enables the spool to be readily and safely lifted and transported, simply by passing the cable hook through the eye and hauling the cable upward, as can now be understood. A considerable factor of safety is had, particularly with the newer, recently developed high-impact plastics, or plastics that are reinforced with fibrous fillers.

Variations and modifications are possible without departing from the spirit of the invention.

I claim:

1. A low-cost, plastic end cone for a heavy-duty dismantleable spool construction adapted to carry a substantial quantity and weight of metal wire, comprising:

(a) a truncated, conical body portion all parts of which are essentially of a uniform thickness of plastic to insure quick and uniform curing of the plastic material, (b) said conical body portion having large and small base parts and having a strengthened peripheral rim encircling its large base part, (c) said rim being of U-shaped cross section and defining an annular groove which faces axially away from the body portion, (d) said body portion having a second annular groove in the exterior of its conical surface, disposed intermediate the large and small base parts thereof, (e) said rim extending radially outward from the large base part of the body portion, and (f) said body portion at its small base part having a transverse wall provided with an aperture to receive a draft bolt.

2. A plastic end cone for a heavy-duty spool as defined in claim 1, wherein:

(a) the said strengthened peripheral rim projects both inwardly of the inner conical surface of the body portion and outwardly of the outer conical surface thereof.

3. A heavy-duty dismantleable spool construction adapted to carry a substantial quantity and weight of metal wire, comprising a pair of end cones as characterized in claim 1, and further including:

(a) a cylindrical spool body constituted of thick and heavy cardboard, (b) the ends of said cylindrical spool body being fitted into the second-mentioned annular grooves of the end cones, and (c) draft means passing through the apertures of the end cones, for holding the same against the ends of the cardboard spool body.

4. A low-cost, plastic end cone for a heavy-duty dismantleable spool construction adapted to carry a substantial quantity and weight of metal wire, comprising:

(a) a truncated, conical body portion all parts of which are essentially of a uniform thickness of plastic to insure quick and uniform curing of the plastic material, (b) said conical body portion having large and small base parts and having a strengthened peripheral rim encircling its large base part, (c) said body portion at its small base part having a transverse wall provided with an aperture to receive a draft bolt, (d) said body portion having a plurality of integral strengthening ribs each of which is disposed both on its exterior and on the exterior of said transverse wall, (e) said ribs lying in planes which pass through the axis of the body portion.

5. A plastic end cone for a heavy-duty spool as defined in claim 4, wherein there are eight of said strengthening ribs.

6. A plastic end cone for a heavy-duty spool as defined in claim 4, wherein:

(a) the conical body portion has an annular groove in its exterior surface, located intermediate the large and small base parts thereof and lying in a plane which is normal to the axis of said body portion, and (b) an annular, integral bead on the inside of said body portion, extending coextensive to said groove and located substantially radially inward thereof.

7. A plastic end cone for a heavy-duty spool as defined in claim 6, wherein:

(a) the body portion has an additional annular groove and integral bead spaced axially from and characterized similarly to the first-mentioned groove and bead.

8. A plastic end cone for a heavy-duty spool as defined in claim 4, wherein:

(a) end portions of the strengthening ribs which are disposed on the transverse wall surround the aperture thereof and taper in height to a lesser dimension adjacent said aperture, thereby to effect a lead-in formation for guiding a draft bolt to the aperture.

9. A plastic end cone for a heavy-duty spool as defined in claim 4, wherein:

(a) the conical body portion has a strengthening peripheral rim encircling its large base part, (b) said rim projecting inwardly of the conical inner surface of the body portion, (c) said body portion having an annular integral bead on its inside, projecting inwardly from its conical inner surface, (d) said integral strengthening ribs projecting outwardly of the conical outer surface of body portion, (e) said rim and bead being adapted to engage the outer conical surface of a second end cone nested in and identical to the first-mentioned end cone, (f) the strengthening rib of said second end cone being adapted for engagement with the inner conical surface of the first-mentioned end cone during nesting of said cones for storage.

* * * * *